United States Patent [19]

Millette

[11] Patent Number: 4,821,357

[45] Date of Patent: Apr. 18, 1989

[54] SCRAPER ADAPTOR FOR ROTARY BUFFER

[76] Inventor: Edgar Millette, 171 Chemin St Ours, Sorel (Québec) J3P 2L4, Canada

[21] Appl. No.: 159,131

[22] Filed: Feb. 23, 1988

[51] Int. Cl.[4] ..... A47L 11/12

[52] U.S. Cl. ..... 15/93 R; 15/22 R; 30/272 A; 51/170 MT; 299/37

[58] Field of Search ..... 15/22 R, 22 A, 93 R, 15/97 R, 49 RB; 299/37; 51/170 TL, 170 MT; 30/169, 272 R, 272 A

[56] References Cited

U.S. PATENT DOCUMENTS

| | | | |
|---|---|---|---|
| 2,193,418 | 3/1940 | George | 51/170 TL |
| 2,465,192 | 3/1949 | Booth | 262/13 |
| 2,526,976 | 10/1950 | Smith | 74/44 |
| 2,715,804 | 8/1955 | Wickes | 51/170 TL |
| 2,722,789 | 11/1955 | Robins | 51/170 TL |
| 2,736,351 | 2/1956 | Baker | 143/60 |
| 3,052,950 | 9/1962 | Civitelli | 29/76 |
| 3,399,441 | 9/1968 | Imamura | 29/81 |
| 4,182,000 | 1/1980 | Fairbairn | 15/236 |
| 4,286,383 | 9/1981 | Farden | 15/93 R X |
| 4,686,797 | 8/1987 | Hoffman | 51/170 TL |

FOREIGN PATENT DOCUMENTS

| | | | |
|---|---|---|---|
| 1091481 | 1/1954 | France | 51/170.3 |

*Primary Examiner*—Edward L. Roberts
*Attorney, Agent, or Firm*—Edwin E. Greigg

[57] ABSTRACT

A removable adaptor for a power-operated rotary implement, comprises a circularly vibrating lower plate. When a blade is attached to this plate, an efficient scraper is provided for removal of adhered materials, such as old under-carpets. Past scrapers relying on longitudinal reciprocal motion have suffered from underpowering and jamming. These problems are avoided by the present invention.

22 Claims, 4 Drawing Sheets

SCRAPER ADAPTOR FOR ROTARY BUFFER

BACKGROUND OF THE INVENTION (i) Field of the invention

This invention relates to a removable adaptor for a power operated rotary implement. More particularly, the invention relates to a scraper adaptor for a rotative buffer, for removing, for instance, old floor or wall coverings, or other adhered material, from various surfaces.

(ii) Description of the Prior Art

U.S. Pat. No. 2,465,192 discloses a scraping apparatus making use of a guidable, reciprocating blade attached to a pneumatic hammer resting on a pushable carriage. This apparatus is designed for roofing repairs and other large scale jobs.

U.S. Pat. No. 2,526,976 discloses a power-operated hand tool which has both rotary and reciprocal modes of operation depending on the task in hand. The exemplified use of the reciprocal mode is sanding. Conversion from rotational to reciprocal motion is achieved by an eccentric mounting system.

U.S. Pat. No. 2,736,351 and U.S. Pat. No. 3,052,950 both describe hand-held sawing or sanding tools driven by a small electric motor. The motor is used to drive a device which converts rotation of the motor into reciprocation of one or more sliding plates.

U.S. Pat. No. 3,399,441 describes a high speed, recoilless chisel device containing a mechanism for converting rotation into reciprocation of the chisel via the eccentric mounting of a shaft.

U.S. Pat. No. 4,182,000 describes a scraper attachment for a hand held power sander employing reciprocal motion.

It has been discovered that the sanders of the prior art, when converted for use as scrapers, suffer from lack of power and after brief use the blade of the scraper jams into the material being removed.

OBJECTS OF THE INVENTION

It is therefore desired to provide a scraper adaptor for a rotary sander, which will overcome the above problems.

It is also desired to provide, more generally, an adaptor for a rotary implement, the adaptor comprising an element vibrating in a circular manner with respect to the implement which may be hand held.

SUMMARY OF THE INVENTION

In meeting the above and other objects, the invention provides a removable adaptor for a powered rotary implement providing rotation of an shaft which forms part of said implement, said adaptor comprising:

- an upper plate;
- securing means for securing said upper plate to said implement;
- a lower plate substantially parallel to said upper plate;
- cam means, disposed in a central area between said plates, for converting rotation of the shaft of said implement to low amplitude circular vibration of said lower plate;
- flexible attachment means disposed between said plates such that said plates are held fixedly apart while allowing circular vibration of said lower plate relative to said upper plate.

When used as a scraper, the present invention demonstrates greatly improved power.

BRIEF DESCRIPTION OF THE DRAWINGS

Further objects, advantages and other features of the present invention will become more apparent upon reading the following non-restrictive description of preferred embodiments thereof, made with reference to the accompanying drawings, in which.

In what follows, the same label numbers refer to all figures.

DESCRIPTION OF PREFERRED EMBODIMENTS

Figure 1:
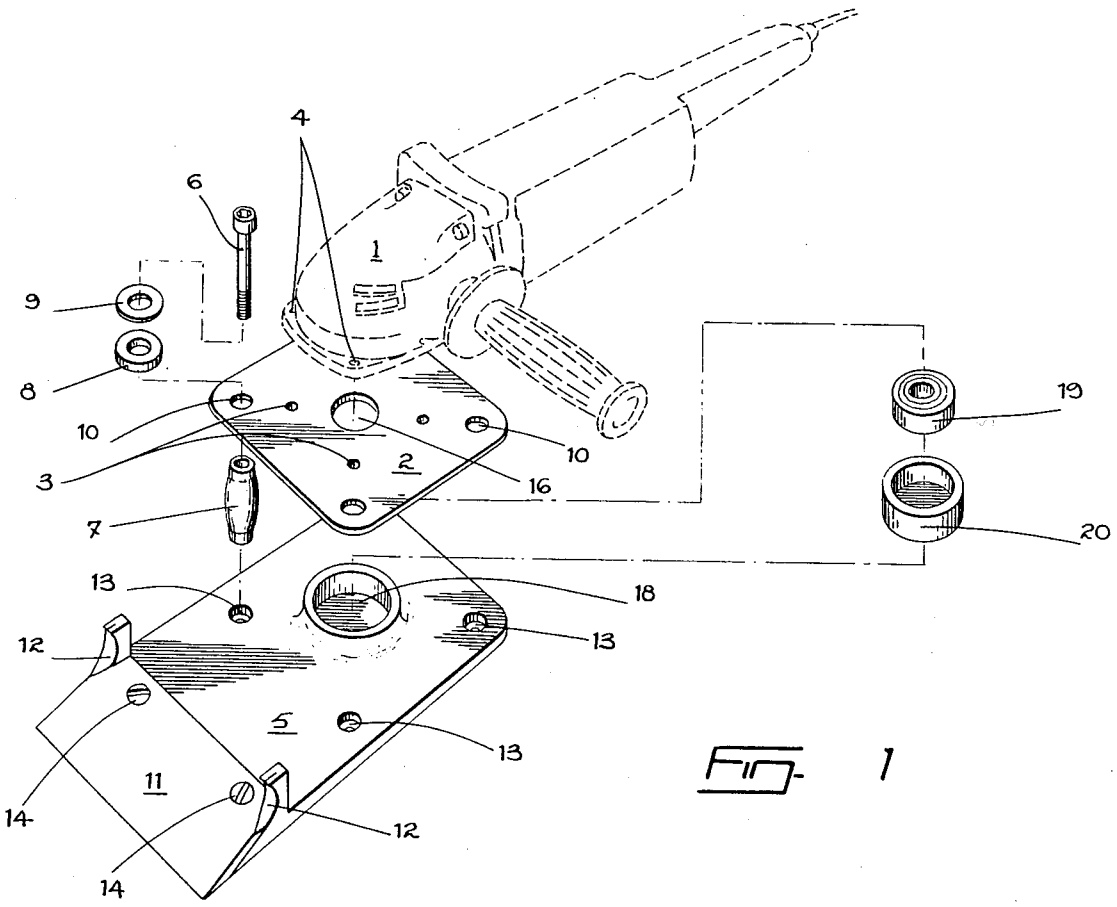
FIG. 1 is an exploded view of a scraper adaptor in perspective.

Referring to FIG. 1, the upper plate (2) of the adaptor is secured to the rotary implement (1) using any suitable securing means, such as bolts (not shown), which pass through upper plate holes (3) and through corresponding implement holes (4) in the part of the rotatory implement (1) which receives the upper plate (2).

The lower plate (5) is held fixedly a set distance apart from the upper plate (4) by flexible attachment means.

By "flexible" is meant allowing a circular, vibrational, low amplitude displacement of the lower plate (5) with respect to the upper plate (2). This is preferably achieved, as illustrated, by using more than one individual rigid fastening device e.g. a bolt (6) each surrounded by a flexible bushing (7) press-fitted at either end into corresponding holes (10 and 13) in the upper and lower plates (2 and 5) respectively.

Figure 2:
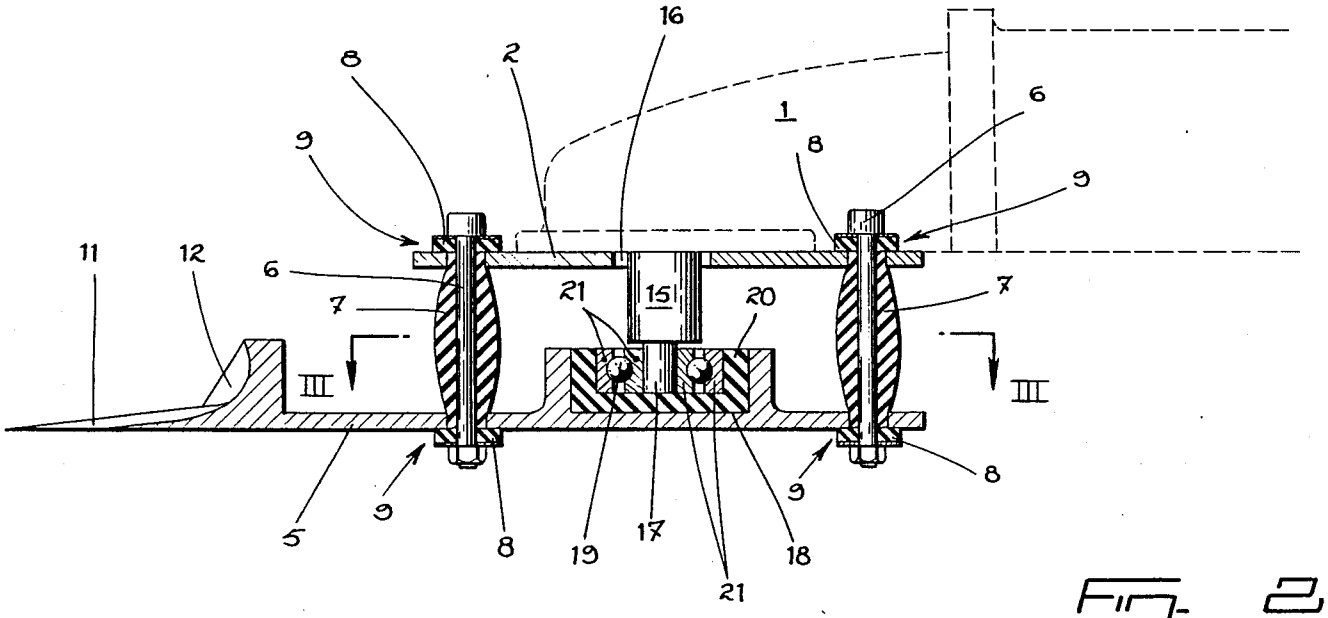
FIG. 2 is a cross sectional view of an assembled adaptor.

In the variation illustrated in FIG. 2, this bushing (7) advantageously has each of its ends formed into a circular step with a central annular protruding portion. Thus in the assembled adaptor, the step rests against the portion of the plate (2 or 5) adjacent to the hole (10 or 13) while the protruding portion of the bushing (7) is press-fitted into the hole (10 or 13). This design allows a greater thickness of flexible material to be used which may imbue the bushing with greater durability.

Figure 4:
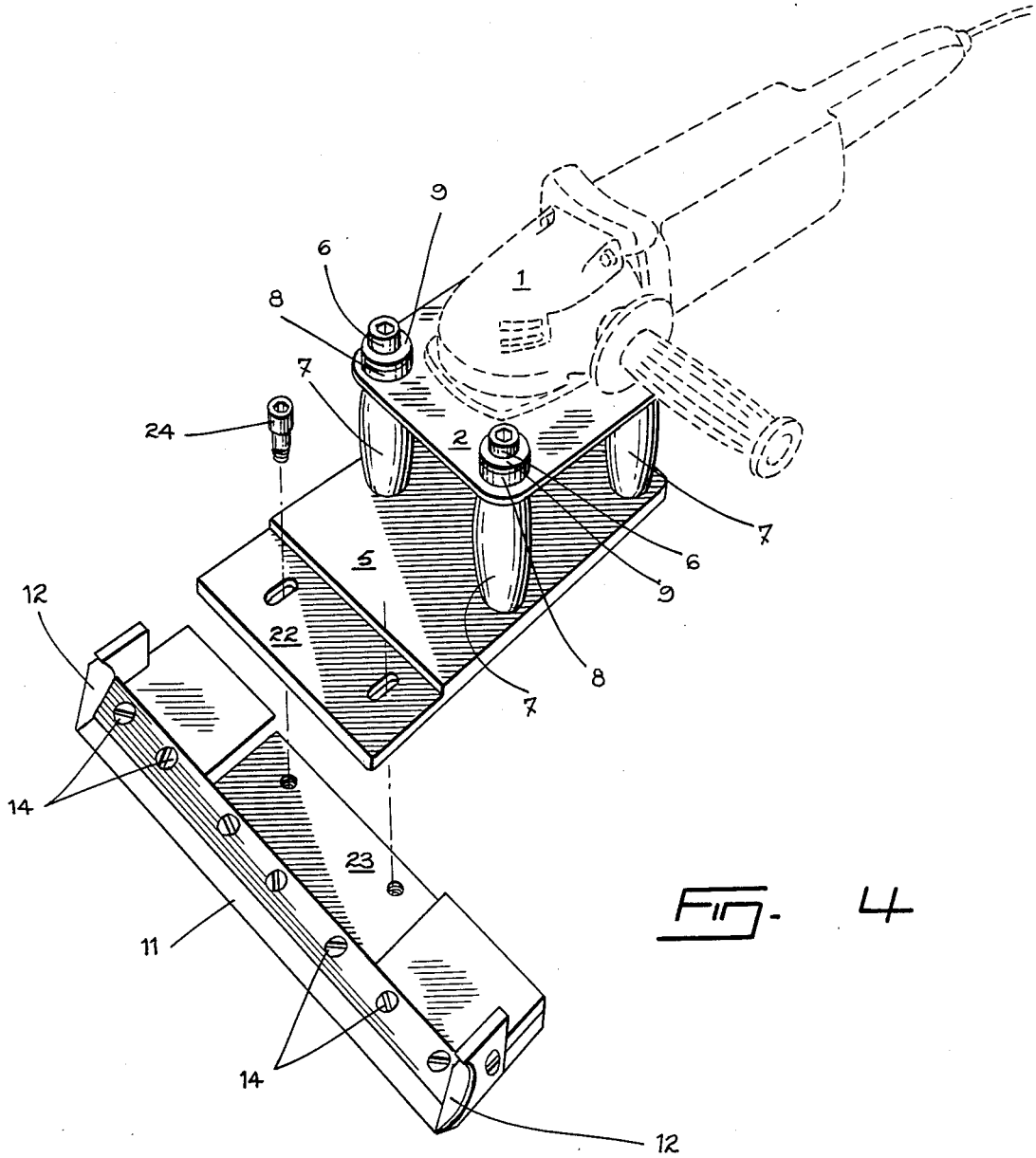
FIG. 4 is a partially exploded view of a scraper adaptor in perspective with a large blade.

As seen in FIGS. 1, 2 and 4, a flexible washer (8) is interposed between the fastening device (6) and the plate (2 or 5) to allow some play in the assembled system. The plates (2 and 5) are prevented from moving significantly up and down (i.e. towards and away from each other) by the fastening devices (6) and by a bulge in the mid-portion of each bushing (7) and/or by the abovementioned step formation at the end of each bushing. However, one plate is able to vibrate circularly, in its own plane, with respect to the other plate, owing to the slack introduced into the adaptor by the flexible bushing (7) and by the flexible washers (8). The material preferably used for these flexible components is rubber.

It is preferred that where the upper plate (2) is rectangular, or better, square, four fastening devices be used, each near a corner of the plate (2) as shown in the figure.

Two sets of washers are preferably used for each such fastening device so that each of the above mentioned flexible washers (8) is sandwiched between the plate (2 or 5) and a metal washer (9) before insertion of the fastening device.

When the adaptor according to the invention is to be used as a scraper, a scraper blade (11) is disposed along one edge of the lower plate (5). Normally if one edge is chosen, it would be the forward edge in relation to the orientation of the rotary implement (1). The blade (11) preferably carries a transverse cutting edge (12) at either end in order to cut any material being removed, into a strip. In some cases it is desirable to have such a cutting edge (12) at one end only of the blade (11). A fuller explanation of this transverse cutting edge is given in copending Canadian patent application No. 536,347 (U.S. patent application Ser. No. 045,296) in the name of the present applicant.

The blade (11) is preferably detachable and may be secured by screws (14) or similar fastening device.

FIG. 4 shows a variation of the apparatus of FIG. 1 where the blade (11) is longer than the side of the lower plate (5) to which it is attached. Indeed the side (22) of the lower plate (5) where blades (11) may be attached preferably allows for a plethora of variously sized bladers or other tools to be so attached. Furthermore the attachment may be adjustable to allow angular positioning of the blade or other tool with respect to the direction of forward motion of the implement. In the illustrated embodiment, screws (24) secure a mounting portion (23) directly to the front side (22) of the lower plate (5). The blade (11) itself is then mounted onto the mounting portion (23) again by using screws (14) or similar means. As before transverse cutting edges (12) may be carried at one or both ends of the blade (4).

Turning to FIG. 2, the same example of flexible attachment means, as shown in FIG. 1, is shown in cross-section. Thus the bolts (6) protrude from the bottom surface of the lower plate, where, as for the upper plate, flexible washers (8) and metal washers (9) are preferably used. This protrusion of the attachment means does not necessarily impede forward motion of the implement (1) with the inventive adaptor, when used as a scraper for instance, since such machines are generally used at an angle to the surface being scraped. If, on the contrary, it is desired to place the bottom surface of the lower plate flush onto a flat surface, then the lower plate may be suitably adapted to achieve this, so that for instance the protruding attachment means may be accomodated into an inverted well (not shown) formed in the lower plate.

The adaptor according to the invention relies on a cam means for its proper operation. This cam means is disposed between the plates (2 and 5) and converts rotational energy, provided by the rotary implement (1), into circular vibrational motion of the lower plate (5).

The preferred cam means, shown in FIG. 2, comprises a first spindle (15) attachable to the shaft (not shown) of the rotary implement (1), and which passes through a hole (16) in the upper plate (2). A second spindle (17) is attached eccentrically to the lower end of the first spindle (15).

This second spindle (17) sits and rotates in a recess (18) (see also FIG. 1) in the lower plate (5). This recess (18) may be moulded to form part of the plate (5)—as shown in the figures—or may be affixed by other means (not shown). Alternatively the second spindle may be attached directly (i.e. non-rotatably) to the lower plate (5) and instead rotate at its eccentric connection with the first spindle.

Thus, in either case, rotation of the first spindle (15), through its attachment to the shaft of the rotary implement (1), causes the eccentrically connected second spindle (17) to move in a circular manner about the longitudinal axis of the first spindle (15). This circular movement of the second spindle (17) causes the lower plate (5) also to move circularly with respect to the upper plate (2). Such motion is allowed by the flexible attachment means (6 and 7) holding the plates (2 and 5) in an equilibrium position from which displacement in any direction is possible. The result is a circularly vibrating lower plate (5) which has great utility, for instance as a scraper adaptor when a blade (11) is in place.

The rotatable connection discussed above may be achieved by any friction reducing device or simply by the sliding of metal against metal (or other material being used) but preferably a ring of ball bearings (18) is provided. In the embodiment shown in the figures, this ring (18) surrounds the portion of the second spindle (17) which is positioned in the recess (18) of the lower plate (5).

In the alternative embodiment mentioned above (not shown) the ring of ball bearings (19) (or other friction reducing device) may be eccentrically attached to the lower end of the first spindle so that the ring itself is rotated eccentrically by the shaft of the rotary implement (1). By this means, the second spindle (17) both rotates around its own axis in the ring, but also is forced to rotate about an axis not its own thereby causing the lower plate (to which the second spindle is directly attached) to move in a circular manner.

In either of these embodiments, it is preferred that the antifriction device (e.g. ball bearings) rests in a cup (20) made of flexible material, preferably rubber.

In the embodiment shown in the drawings, this cup (20) sits directly in the recess (18) in the lower plate (5).

Figure 3:
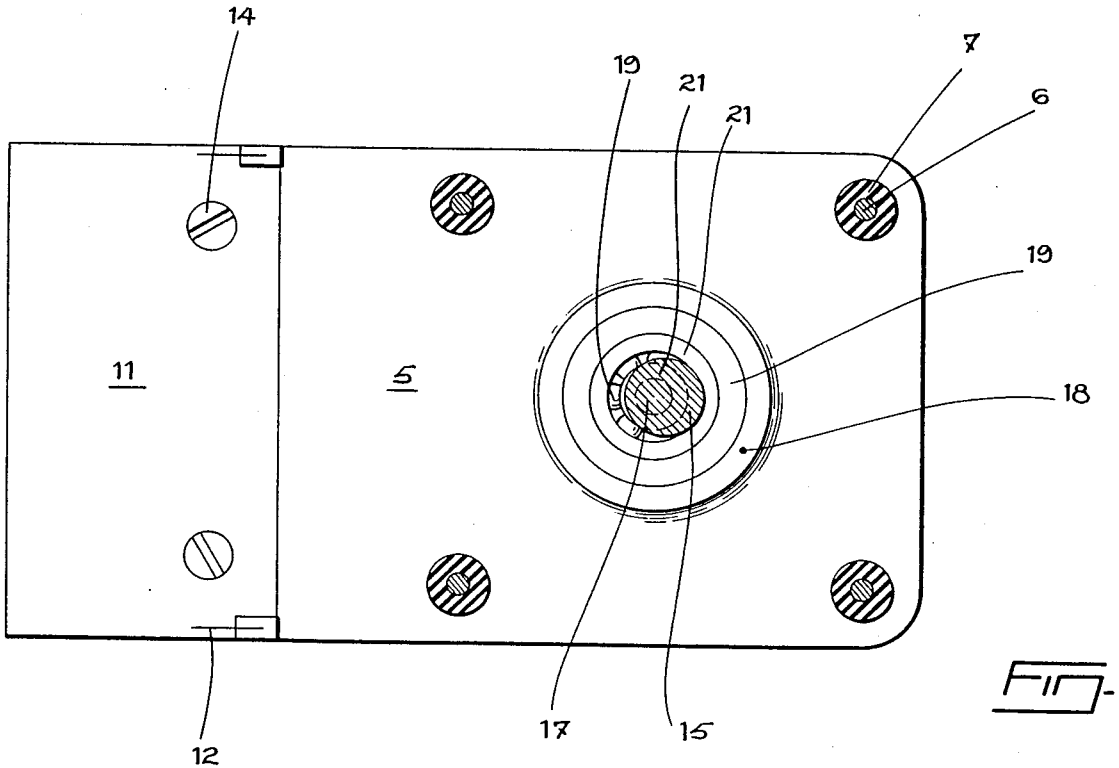
FIG. 3 is a cross-sectional view taken along the line III—III in FIG. 2.

Turning to FIG. 3, it is clearly shown that the first spindle (15) is eccentric with respect to the second spindle (17) which is surrounded by ball bearings (19). The ball bearings (19) are encased on either side by casings (21) to create an annular structure (see also FIG. 2). This annular structure sits in the rubber cup (20) in turn positioned in the recess (18) of the bottom plate (5).

The degree of eccentricity of the first spindle (15) with respect to the second spindle (17) may of course be varied. However in practice, a displacement between respective axes of about 1/32 inch has been found to be suitable. This gives an amplitude of 1/16 inch displacement of the lower plate with respect to the upper plate. Rotation speed of the first spindle may be in the range from 8,000 to 10,000 Rpm.

A suitable rotary implement for use with the adaptor according to the present invention is a rotation sander such as the BOSCH 1322 (trade mark).

While there have been shown and described what are at present believed to be the preferred embodiments of the invention, it will be obvious to those skilled in the art that various changes and modifications may be made to them without departing from the scope of the invention as defined by the appended claims.

What is claimed is:

1. A removable tool-bearing adaptor for a powered rotary implement providing rotation of a shaft which forms part of said implement, said adaptor comprising:

an upper plate;

securing means for securing said upper plate to said implement;

said tool being borne by a lower plate substantially parallel to said upper plate;

cam means, disposed in a central area between said plates, for converting rotation of the shaft of said implement to low amplitude circular vibration of said lower plate;

a plurality of flexible attachment means disposed substantially perpendicularly between said plates, each said attachment comprising:

(a) a rigid, two-ended fastening device;

(b) a two-ended flexible bushing surrounding said device and press-fitted at each end thereof into means defining holes in said plates;

(c) a pair of securing means, each securing means being securable to each end of said fastening device projecting from said bushing; and (d) a pair of flexible washers, each washer being disposed between said securing means and said plate and being sized to prevent passage of said securing means through said means defining holes;

whereby said plates are fixedly held in spaced relation while allowing low amplitude circular vibration of said lower plate relative to said upper plate.

2. A removable adaptor according to claim 1, said cam means comprising:

a first spindle attached at its upper end to, and rotatable about its longitudinal axis by, said shaft, said spindle passing through said upper plate;

a second spindle having an eccentric fitting adapted to fit to the lower end of said first spindle, a lower portion of said second spindle having a fitting in a recess in said lower plate, and one of said fittings being rotatable.

3. A removable adaptor according to claim 2, wherein said second spindle is fixed eccentrically to the lower end of said first spindle and the lower portion of said second spindle is fitted rotatably into said recess.

4. A removable adaptor according to claim 3, wherein said rotatable fitting is achieved by a ring of ball bearings around the portion of said second spindle fitted into said recess.

5. A removable adaptor according to claim 4, wherein said ring of bearings is surrounded by a flexible cup-shaped receptacle fitted into said recess.

6. A removable adaptor according to claim 5, wherein said flexible washers, flexible bushings and said receptacle are made of rubber.

7. A removable adaptor according to claim 6, wherein said lower plate has a blade on at least an edge thereof.

8. A removable adaptor according to claim 7, wherein said blade has at least at one end thereof, a cutting edge extending transversely to said blade.

9. A removable adaptor according to claim 8, said blade having two cutting edges, one at each end of the blade.

10. A removable adaptor according to claim 9, wherein said blade is removably attached to said lower plate.

11. A removable adaptor according to claim 5, wherein said recess is formed in an upwardly raised portion of said lower plate.

12. A removable adaptor according to claim 4, comprising four such fastening devices positioned in a square configuration around said central area.

13. A removable adaptor according to claim 12, wherein said plates are substantially rectangular.

14. A removable adaptor according to claim 13, wherein said four fastening devices are positioned near each corner of said plate.

15. A removable scraper adaptor for a powered rotary implement providing rotation of a shaft which forms part of said implement, said adaptor comprising:

an upper plate;

securing means for securing said upper plate to said implement;

a lower plate substantially parallel to said upper plate, said lower plate having a blade on at least an edge thereof;

cam means, disposed in a central area between said plates for converting rotation of the shaft of said implement to low amplitude circular vibration of said lower plate; said cam means comprising:

(i) a first spindle attached at its upper end to, and rotatable about its longitudinal axis by, said shaft, said spindle adapted to pass through said upper plate;

(ii) a second spindle disposed eccentrically with respect to a lower end of said first spindle, a lower portion of said second spindle being rotatably fitted into a ring of ball bearings surrounded by a flexible cup shaped rubber receptacle fitted into a recess in said lower plate;

a plurality of flexible attachment means disposed substantially perpendicularly between said plates, each said attachment means comprising:

(a) a rigid, two-ended fastening device;

(b) a two-ended flexible rubber bushing surrounding said device and press-fitted at each end thereof into means defining holes in said plates;

(c) a pair of securing means, each securing means being securable to each one of said fastening device projecting from said bushing; and (d) a pair of flexible rubber washers, each washer being disposed between said securing means and said plate and being sized to prevent passage of said securing means through said means defining holes;

whereby said plates are fixedly held in spaced relation while allowing low amplitude circular vibration of said lower plate relative to said upper plate.

16. A removable adaptor according to claim 15, wherein said blade has on at least one end thereof, a cutting edge extending transversely of said blade.

17. A removable adaptor according to claim 16, said blade having two cutting edges, one at each end of said blade.

18. A removable adaptor according to claim 17, wherein said blade is removably attached to said lower blade.

19. A removable adaptor according to claim 18, wherein said recess is formed in an upwardly raised portion of said lower plate.

20. A removable adaptor according to claim 19, comprising four said fastening devices positioned in a square configuration around said central area.

21. A removable adaptor according to claim 20, wherein said plates are substantially rectangular.

22. A removable adaptor according to claim 21, wherein said four fastening devices are positioned near each corner of said plate.

* * * * *